United States Patent [19]

Yie

[11] 4,190,202

[45] Feb. 26, 1980

[54] HIGH PRESSURE PULSED WATER JET

[75] Inventor: Gene G. Yie, Chicago, Ill.

[73] Assignee: Institute of Gas Technology, Chicago, Ill.

[21] Appl. No.: 921,216

[22] Filed: Jul. 3, 1978

[51] Int. Cl.[2] ..... B05B 1/08

[52] U.S. Cl. ..... 239/101; 299/17

[58] Field of Search ..... 239/101, 102, 172, 332; 299/17, 36

[56] References Cited

U.S. PATENT DOCUMENTS 3,784,103 1/1974 Cooley ..... 239/101

4,074,858 2/1978 Burns et al. ..... 239/172

*Primary Examiner*—James B. Marbert

*Attorney, Agent, or Firm*—Thomas W. Speckman

[57] ABSTRACT

A thrust generator combining gas driving either directly or through a hydraulic fluid with gas or hydraulic fluid cocking in a compact, lightweight thrust generator suitable for repetitive operation. The thrust generator has control fluid triggering of the power stroke and a floating piston for separating hydraulic fluid and gas. The thrust generator of this invention is particularly suited for provision of an integrated thrust generator-high pressure pulsed water jet apparatus.

26 Claims, 4 Drawing Figures

HYDRAULIC FLUID
150
111
112
152
116
10
117
60
42
124
122
42
13
46
47
48
39
45
30
38
35
119
37
36
85
120 A
34
33
20
95
41
43
93
95
21
61
92
162
88
96
184
94
163
WATER
98
99
91
97
90
89
JET

HIGH PRESSURE PULSED WATER JET

In mining and in demolition, it is necessary to fracture hard materials including coals, ores, rocks and concrete. Further, many utility systems in urban areas are installed beneath street pavements and require frequent breaking of the pavement for purposes of installation and repair.

Currently, materials such as rock, ore, coal, concrete and asphalt, are commonly fractured with mechanical tools which cause fractures by overcoming the compressive strength, impact resistance, or shear strength of the materials involved. For example, rotary cutters are widely used today to shear off coal and pneumatic or hydraulic impactors are used to break up rocks and ores. Asphalt and concrete pavements are usually fractured today by pneumatic, hydraulic or drop weight hammers.

Since these conventional tools all function on impacting or shearing the materials with a metallic cutter, impactor, or moil, they have some common problems. These problems included wear and tear of the tool, generation of dust, generation of noise and vibration, and lack of efficiency. Consequently, efforts have been directed toward the development of improved techniques and equipment for breaking hard and brittle minerals.

High pressure water jets, pulsed or continuous, have found use in cutting, slitting and breaking porous and/or brittle materials such as rocks and concrete. The water jet processes have many advantages over existing mechanical techniques, such as pneumatic and hydraulic hammers, in the areas of efficiency, noise generation, dust generation, tool wear, vibration and shocks. Pulsed water jets can be particularly effective in fracturing rocks, ores, concrete and other brittle materials, by overcoming the tensile strength of the materials instead of the compressive strength dealt with by the conventional mechanical techniques. Since the tensile strength of the cited materials is considerably lower than their respective compressive strength, the energy required to fracture these materials with water jets is, therefore, comparatively lower.

The pressure extrusion technique of generating pulsed water jets of high velocity has been found to be the most practical means of producing the desired pulsed water jets. The ability of a pulsed water jet generated by pressure extrusion for fracturing concrete has been found to depend upon several parameters including water jet pressure, nozzle diameter, volume of water per pulse, nozzle standoff distance, and the method of applying the jet to the concrete surface. The practicality of the pulsed water jet technique is also related to the repetitive rate of the water jet and the energy required to remove a given volume of concrete, the specific energy of concrete breaking. An ideal water pulsed jet system should have a high repetitive rate, flexible adjustment of jet parameters, low specific energy, high efficiency, lightweight, compactness, ruggedness and ease of operations.

Using the pressure extrusion technique of generating a water pulsed jet, it has been found that the volume of concrete removed by each pulse is closely related to the amount of kinetic energy contained in each jet pulse and the manner in which the energy is imparted to the concrete or rocks. To increase the removal rate, it is necessary to generate secondary fractures by creating high hoop stresses inside the material by virtue of the water jet pulse. Thus, an ideal pulsed water jet is one that can rapidly erode concrete or rocks to create a hole of sufficient depth and has sufficient energy remaining to generate high hoop stresses around the hole, to initiate fractures, and to cause the fractures to propagate through a wedge effect.

An apparatus and process based on the pressure extrusion technique for producing high velocity water jet pulses for fracturing rocks and concrete is in U.S. Pat. No. 4,074,858. Suitable thrust generators for use with the high pressure water jet apparatus as disclosed in U.S. Pat. No. 4,074,858 have been described in U.S. Pat. Nos. 3,999,384 and 4,052,850. Tests with the high pressure pulsed water jet apparatus described in U.S. Pat. No. 4,074,858 have indicated that superior performance in fracturing concrete is associated with jet pulses of high velocity and large volume of water. To obtain jet pulses of high velocity and high volume of water, the pulse jet intensifier must have a relatively large nozzle orifice and a thrust generator capable of generating high velocity water ram stroke without substantial loss of force. Therefore, the drag produced in the thrust generator by hydraulic oil flowing through limited openings at high velocity must be reduced and cavitation actions occurring above the power piston must be reduced. The apparatus of the present invention provides much greater passage areas for hydraulic oil flow and reduces cavitation. Furthermore, the apparatus of the present invention allows the power piston to be driven by compressed gas which requires smaller passage area due to the compressibility of the gas. The apparatus of the present invention has also eliminated the need for external gas accumulators and connecting hoses and reduced the overall length of the combined intensifier-water jet apparatus by approximately 50% without sacrifice of performance. The efficient utilization of space with concentric passages and concentric cylinders has significantly reduced the weight of the appratus.

It is an object of this invention to provide a thrust generator which overcomes many of the disadvantages of thrust generators presently available.

One object of this invention is to provide a thrust generator utilizing concentric cylinders to form necessary chambers and thereby provide a compact, lightweight thrust generator suitable for repetitive operation.

Another object of this invention is to provide an integrated thrust generator and high pressure pulsed water jet apparatus utilizing a double-ended power piston having a hollow piston rod at each end for direct use in conjunction with water jet generation.

Yet another object of this invention is to provide a thrust generator having fluid passages of ample size to significantly decrease drag of fluid generated during the power stroke.

Still another object of this invention is to provide a thrust generator having controlled fluid triggering of the power stroke.

Yet another object of this invention is to provide an apparatus utilizing a floating piston means for separating hydraulic fluid and gas and for controlling the operation of the power piston.

A further object of this invention is to provide a thrust generator apparatus which operates by oil driving and gas cocking, or by gas driving and oil cocking.

Other objects and advantages of this invention will be apparent from the following description taken in conjunction with the accompanying drawings showing preferred embodiments wherein.

Figure 1:
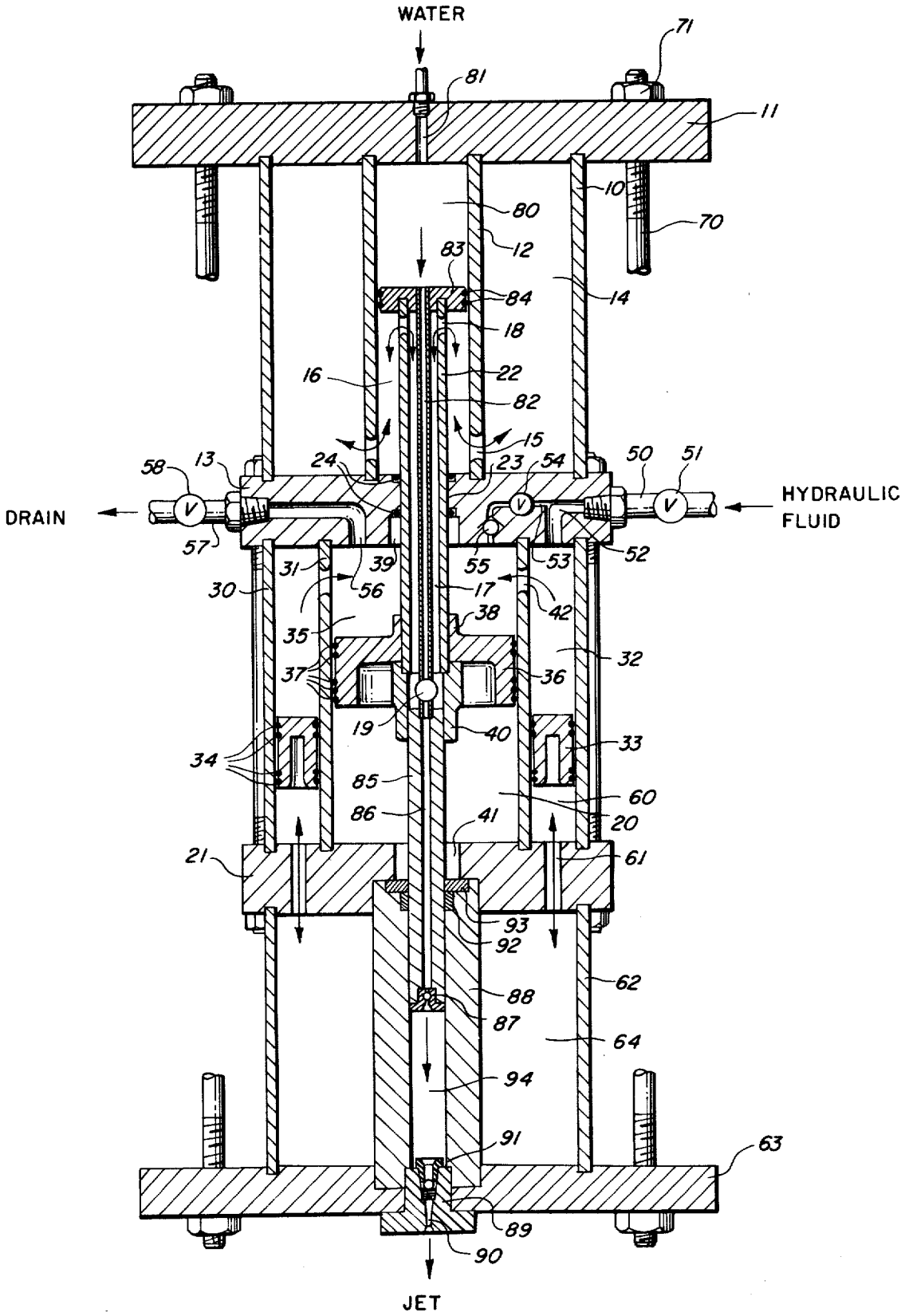
FIG. 1 is a partially sectioned view of one embodiment of a high pressure pulsed water jet intensifier of this invention having oil driving, gas holding and gas cocking.

FIG. 1 shows a double ended power piston assembly in an integrated high pressure pulsed water jet intensifier shown in a vertical postion, comprising upper cocking gas chamber 14 and water chamber 80 in the upper section formed by upper cocking cylinder external end plate 11, outer upper cocking cylinder wall 10, water cylinder wall 12, and upper cocking cylinder internal end plate 13. Water cylinder wall 12 has upper cocking gas chamber passages 15 in the lower portion to allow cocking gas to pass from upper cocking gas chamber 14 to annular upper cocking gas chamber 16. Annular upper cocking gas chamber 16 is in communication through connecting gas passages 18 to annular cocking gas passage 17 which is in communication at its lower end with cocking chamber 20 through lower cocking gas passages 19.

The central portion, as shown in FIG. 1, comprises outer working cylinder wall 30, inner working cylinder wall 31, together with upper cocking cylinder internal end plate 13 and lower cocking cylinder end plate 21. Floating piston 33 is located between outer working cylinder wall 30 and inner working cylinder wall 31 and has seals 34 providing substantially gas-tight movement. Floating piston 33 divides the annular space between outer working cylinder wall 30 and inner working cylinder wall 31 to form working fluid charging chamber 32 and upper driving gas chamber 60. Inner working cylinder wall 31 has working fluid inter-chamber passages 42 in its upper portion for passage of working fluid from working fluid charging chamber 32 to working fluid working chamber 35. Power piston 36 moves within the cavity formed by the inner surface of inner working cylinder wall 31 and is maintained movable in substantially gas-tight relation by power piston seals 37. Power piston 36 divides the cavity formed by the inner surface of inner working cylinder wall 31 forming working chamber 35 and cocking chamber 20. Power piston 36 has power piston upper cushion plunger 38 and power piston lower cushion plunger 40. Cocking gas communication cylinder 22 extends from the upper side of power piston 36 and water ram 85 extends from the lower side. Annular through cocking gas passage 17 within cocking gas communication cylinder 22 is in communication with cocking chamber 20 and upper cocking gas chamber 14. The upper end of water ram passage 86 in water ram 85 is in communication with the lower end of water feed tube 82 which extends from the upper end of water ram 85 through annular cocking gas passage 17 through water piston 83 to water chamber 80. Water ram passage 86 extends the length of water ram 85 to allow water to pass from water chamber 80 through the length of water feed tube 82 and the length of water ram 85 through water ram passage check valve 87 into high pressure water chamber 94. The upper end of cocking gas communication cylinder 22 always extends through cocking gas communication cylinder hole 23 in upper cocking cylinder internal end plate 13 maintained in substantially gas-tight relation by cocking gas communication cylinder seals 24. Reciprocal movement of water piston 83 changes the volume of water chamber 80 and annular upper cocking gas chamber 16 which is in communication with upper cocking gas chamber 14. The connecting cocking gas passages 18 in the upper end of cocking gas communication cylinder 22 and upper cocking gas chamber passages 15 in the lower end of inner upper cocking cylinder wall 12 allow gas to pass from upper cocking gas chamber 14 to lower cocking gas chamber 20 through annular upper cocking gas chamber 16 and annular through cocking gas passage 17 through lower cocking gas passages 19 in accordance with such reciprocal movement.

Upper cocking cylinder internal end plate 13 has working fluid supply port 52 in communication with working fluid charging chamber 32 and working fluid outlet port 56 in communication with working fluid working chamber 35. Upper cocking cylinder internal end plate 13 also has working fluid supply bleed passage 53 extending from working fluid supply port 52, or from outside of upper cocking cylinder internal end plate 13, to working fluid working chamber 35. Working fluid supply bleed passage 53 has working fluid supply bleed check valve 55 and working fluid supply bleed trigger valve 54 providing a means to introduce a slug of high pressure working fluid to trigger the movement of power piston 36. Working fluid supply bleed check valve 55 and working fluid supply bleed trigger valve 54 as shown in FIG. 1, are situated within upper cocking cylinder internal end plate 13, but may also be situated in any suitable location, such as in upper cocking gas chamber 14. Working fluid supply port 52 is in communication with working fluid supply conduit 50 and working fluid supply valve 15. Working fluid supply conduit is in communication with suitable pump means and storage means to supply required volumes of working fluid at desired high pressure. Working fluid outlet port 56 is in communication with working fluid outlet conduit 57 and working fluid outlet valve 58. Working fluid may be recycled from outlet conduit 57 to the storage means for recycle to supply conduit 50.

The lower section comprises driving gas outer cylinder wall 62 with high pressure water cylinder wall 88 in its central portion, lower cocking chamber end plate 21 and driving gas cylinder end plate 63 with high pressure water cylinder nozzle plug 89 in its central portion. Driving gas outer cylinder wall 62 and high pressure water cylinder wall 88 form lower driving gas chamber 64 which is in communication with upper driving gas chamber 60 through driving gas passages 61 in lower cocking chamber end plate 21. High pressure water cylinder wall 88 forms high pressure water chamber 94 into which the lower end of water ram 85 always extends and high pressure water seal assembly 92 with high pressure water seal assembly retainer 93 provides substantially water tight relation between high pressure water chamber 94 and lower cocking chamber 20 above it. The lower end of high pressure water cylinder wall 88 is in sealed relation with driving gas cylinder end plate 63 and high pressure water cylinder nozzle plug 89. High pressure water cylinder nozzle means includes plug 89 which has high pressure water nozzle check valve 91 and high pressure water nozzle orifice 90 at the lower end. The high pressure water nozzle orifice 90 may be a replaceable plate within nozzle plug 89 so that the nozzle can be readily replaced when it is worn. I have found nozzle orifices of about 0.04 to about 0.12 inch to be suitable.

The apparatus and process as shown in FIG. 1 operates by working oil driving and gas cocking. The high pressure water jet is generated by compression of water in high pressure water chamber 94 by the thrust of water ram 85 downwardly through the high pressure water chamber. The thrust of water ram 85 is derived from power piston 36 and is generated by expansion of compressed gas, such as air or nitrogen, stored in lower driving gas chamber 64 and upper driving gas chamber 60 or in external accumulators through the use of a hydraulic working fluid contained in working fluid charging chamber 32 between upper cocking cylinder internal end plate 13 and the upper surface of floating annular piston 33. The high pressure gas forces floating piston 33 upward and thus forces working fluid through interchamber passages 42 into working chamber 35 forcing power piston 36 downward to generate the thrust. When the power piston is moving downwardly, the low pressure cocking gas in lower cocking chamber 20 below power piston 36 is compressed and is being forced through lower cocking gas chamber passages 19 to annular through cocking gas passage 17 upward and through upper cocking gas chamber passages 15 into upper cocking gas chamber 14 or into external gas accumulator. The pressure of the cocking gas is increased as power piston 36 moves downwardly with the concomitant upwardly movement of floating annular piston 33. The counter movements, the power piston moving downwardly and the floating annular piston moving upwardly, tend to reduce the recoil force generated, thus providing smoother operation. As floating piston 33 moves upwardly it closes interchamber passages 42 cutting off the supply of working fluid to working chamber 35. Simultaneously, power piston 36 approaches the end of the power stroke and is stopped by increased cocking gas pressure in power piston lower cushion chamber 41 and water remaining in high pressure water chamber 94. The volume of working fluid charging chamber 32 is such as to contain the amount of working fluid necessary to drive power piston 36 through almost its entire stroke length so that when interchamber passages 42 are closed just before power piston 36 reaches the end of the power stroke. At the end of the power stroke, working fluid outlet valve 58 opens and the working fluid above power piston 36 flows out of working fluid working chamber 35 through working fluid outlet port 56. Cocking gas flows into lower cocking gas chamber 20 creating higher pressure than the working fluid in working chamber 35 pushing power piston 36 upward. As power piston 36 moves upwardly, water piston 83 forces the water in water chamber 80 into high pressure water chamber 94 through water feed tube 82, water ram passage 86 and water ram passage check valve 87. High pressure water nozzle check valve 91 is spring loaded to maintain check valve 91 in closed position under the water supply pressure, thus preventing the water from flowing out of high pressure water nozzle orifice 90 prior to triggering the intensifier. Power piston 36 reaches its uppermost position closing interchamber passages 42 and power piston upper cushion plunger 38 enters power piston upper cushion chamber 39, the pressure of which stops movement of power piston 36. At that time, working fluid outlet valve 58 closes and working fluid supply valve 51 opens providing high pressure working fluid to working fluid charging chamber 32 through working fluid supply port 52. The high pressure working fluid pushes floating piston 33 downwardly and thus restores the driving force by pressurizing the driving gas. During the downward movement of floating piston 33, interchamber passages 42 remain shut due to the upward position of power piston 36 by means of power piston seals 37, thus preventing the working fluid from entering working fluid working chamber 35. When the predetermined peak driving gas pressure has been attained, working fluid supply trigger valve 54 is opened and high pressure working fluid enters working fluid working chamber 35 through working fluid supply bleed passage 53 and working fluid supply check valve 55. The high pressure working fluid forces power piston 36 downward to initiate the power stroke. When power piston 36 clears interchamber passages 42, a large amount of high pressure working fluid enters working fluid working chamber 35 and power piston 36 rapidly accelerates. At the same time, water enters water chamber 80 through water chamber inlet 81 in upper cocking cylinder external end plate 11. The volume of water chamber 80 is designed so as to supply the required amount of water to fill high pressure water chamber 94, excessive water being pushed back to a supply tank through water chamber inlet 81 during the cocking movement of power piston 36.

The arrangement of power piston 36, water ram 85, and cocking gas communication cylinder 22 of the above described embodiment of this invention, allows precise alignment of power piston 36 minimizing leakage between power piston 36 and inner surface of inner working cylinder wall 31 through power piston seals 37. Placement of cocking gas communication cylinder 22 surrounding water feed tube 82 provides convenient passage for water and cocking gas effectively utilizing the space created by the concentric cylinders. Interchamber passages 42 and their relationship to power piston 36 and floating piston 33, provide triggering the power stroke and minimizing the cocking gas pressure required to hold power piston 36 at its uppermost position prior to triggering. Working fluid supply check valve 55 prevents working fluid from entering trigger valve 54 during the cocking operation which might cause premature opening of trigger valve 54. When a large open area is provided by interchamber passages 42, the drag created by the high velocity flow of working fluid during the power stroke can be reduced, thus preventing significant loss of useful power. The above described embodiment of this invention provides a high pressure pulsed water jet intensifier that is quite compact and simple in form requiring external connection of only two working fluid hoses, one water hose and a control cable. The assembly of cylinders is held together in compact form by tie rods 70, secured by tie rod nuts 71.

Figure 2:
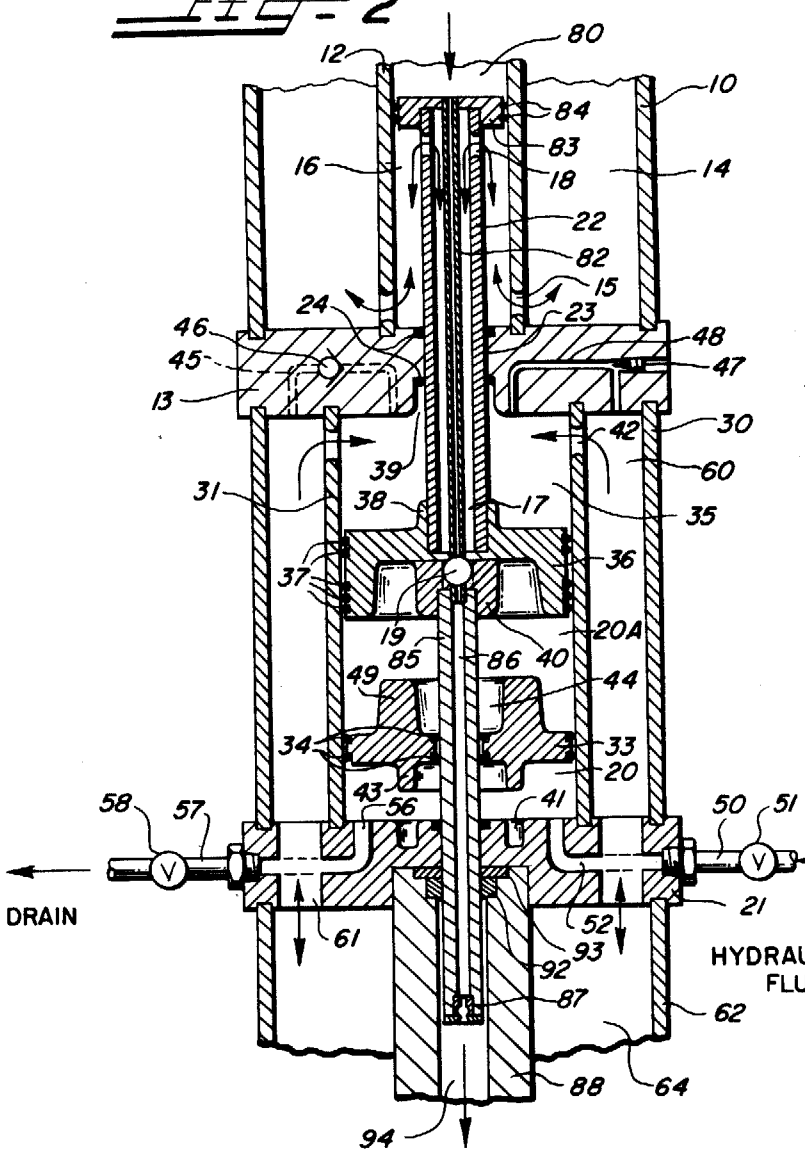
FIG. 2 is a partially sectioned view of another embodiment of a pulsed water jet intensifier of this invention having gas driving, gas holding and oil cocking.

Another embodiment utilizing the principles of this invention is shown in FIG. 2 wherein the pulsed water jet intensifier comprises essentially the same components described with respect to FIG. 1 except an alternate arrangement of the floating piston and the action of the working fluid. As shown in FIG. 2, floating piston 33 is within inner working cylinder wall 31 and is free to slide along water ram 85, being equipped with seals 34 to maintain substantially gastight relation between opposite sides of the floating piston. Working fluid enters through working fluid supply port 52 in lower cocking cylinder end plate 21 into lower cocking gas chamber 20 and is used to cock both floating piston 33 and power piston 36 simultaneously. Power piston 36 is driven completely by driving gas stored in upper driving gas chamber 60 and lower driving gas chamber 64. Working fluid outlet port 56 is located in lower cocking chamber end plate 21 and working fluid in lower cocking chamber 20 can be drained through working fluid outlet port 56 allowing floating piston 33 to be pushed downwardly by cocking gas in chamber 20A prior to downward movement of power piston 36.

At the end of the power stroke of the embodiment shown in FIG. 2, power piston 36 and floating piston 33 are at their lowest positions and are engaged together, lower cushion chamber 41 being occupied by floating piston cushion plunger 43 and floating piston cushion chamber 44 occupied by power piston lower cushion plunger 40 and upper cushion plunger 49 mutually engaged. To initiate the power stroke, working fluid outlet valve 58 is closed and working fluid supply valve 51 opened allowing high pressure working fluid to enter lower cocking chamber 20 through working fluid supply port 52 pushing floating piston 33 and power piston 36 upward. At the same time, water enters high pressure water chamber 94 from water chamber 80 through water feed tube 82 and water ram passage 86, check valve 87 being open, and the driving gas in working chamber 35 is pushed back to lower driving gas chamber 64 through interchamber passages 42, upper driving gas chamber 60 and driving gas passages 61, thus increasing the driving gas pressure. Interchamber passages 42 become closed by power piston 36 and the remaining gas in working chamber 35 is pushed by power piston 36 into upper driving gas chamber 60 through bleed passage 45 and bleed passage check valve 46 located in upper cocking cylinder internal end plate 13. Power piston 36 reaches its uppermost position with power piston upper cushion chamber 39 occupied by power piston upper cushion plunger 38 and high pressure water chamber 94 is completely filled with water. The attainment of uppermost position of power piston 36 can be sensed by a pressure sensor in bleed passage 45 or a position sensor mounted on the lower surface of cocking cylinder internal plate 13. Thus, a signal can be provided to open working fluid outlet valve 58 causing the working fluid to quickly flow out of lower cocking chamber 20. At the same time, floating piston 33 losses its supporting force provided by the working fluid and is thus moved downwardly by cocking gas flowing out of lower cocking gas chamber passages 19 from upper cocking gas chamber 14 through upper cocking gas chamber passages 15, annular upper cocking gas chamber 16, connecting cocking gas passages 18 and annular through cocking gas passage 17. Floating piston 33 reaches its lowest position as floating piston lower cushion plunger 43 enters lower cushion chamber 41. Upper cocking gas chamber 20A is thus filled with cocking gas and power piston 36 held at its uppermost position by the pressure of the cocking gas since inter chamber passages 42 are closed by power piston 36. Power piston 36 will move downwardly when a sufficient amount of pressurized gas has entered working chamber 35 through bleed passage 48 controlled by bleed passage needle valve 47. The amount of time that the power piston will stay at the uppermost position is determined by the opening of bleed passage needle valve 47 which can be precisely adjusted. It is preferred that power piston 36 not move sufficiently to open interchamber passages 42 until floating piston 33 has reached a sufficiently low position so that floating piston cushion plunger 43 is entering lower cushion chamber 41. By so doing, the impact between power piston 36 and floating piston 33 is minimized without significant loss of useful power caused by the back pressure of working fluid draining out of lower cocking chamber 20.

According to the embodiment shown in FIG. 2, power piston 36 moves down rapidly after clearing and opening interchamber passages 42 as high pressure driving gas flows into working chamber 35 from upper driving gas chamber 60. As power piston 36 moves downward, water jet is produced and the cocking gas is pushed back into upper cocking gas chamber 14 from cocking gas chamber 20A through lower cocking gas chamber passages 19. Power piston 36 at the end of its power stroke engages floating piston 33 and is stopped by the increased gas pressurized between the two pistons. The impact of power piston 36 is minimized by mutual engagement of cushion plungers and by water remaining in high pressure water chamber 94. Another cycle is initiated by closing working fluid outlet valve 58 and opening working fluid supply valve 51. Working fluid supply valve 51 can be kept open if repetitive cyclic operation of the intersifier is desired, only working fluid drain valve 58 being controlled. For preferred operation, the working fluid outlet conduit 57 should be sized substantially larger than the working fluid supply conduit 50 so that floating piston 33 can move downward rapidly.

The embodiment of this invention shown in FIG. 2 differs from that shown in FIG. 1 primarily in the means of driving and cocking the power piston. Indirect drive with working oil fluid is used in the embodiment shown in FIG. 1 and some of the driving force provided by the compressed gas is lost due to the drag of the working fluid and possible cavitation in working chamber 35. However, the embodiment shown in FIG. 1 has the advantage of easy stopping of power piston 36 as the driving force is cut off at the end of the power stroke by the position of floating piston 33 and the advantage of recoiless operation provided by the countermovement of power piston 36 and floating piston 33. The direct power drive with gas used in the embodiment shown in FIG. 2 is more efficient as high pressure gas acts directly on power piston 36 and is capable of slightly faster cyclic operation as power piston 36 and floating piston 33 can be made to move closely together instead of the two step operation utilized in the embodiment shown in FIG. 1. The embodiment shown in FIG. 2, however, has the disadvantage of requiring a more precision-made power piston 36 and floating piston 33 to provide proper cushioning.

Figure 3:
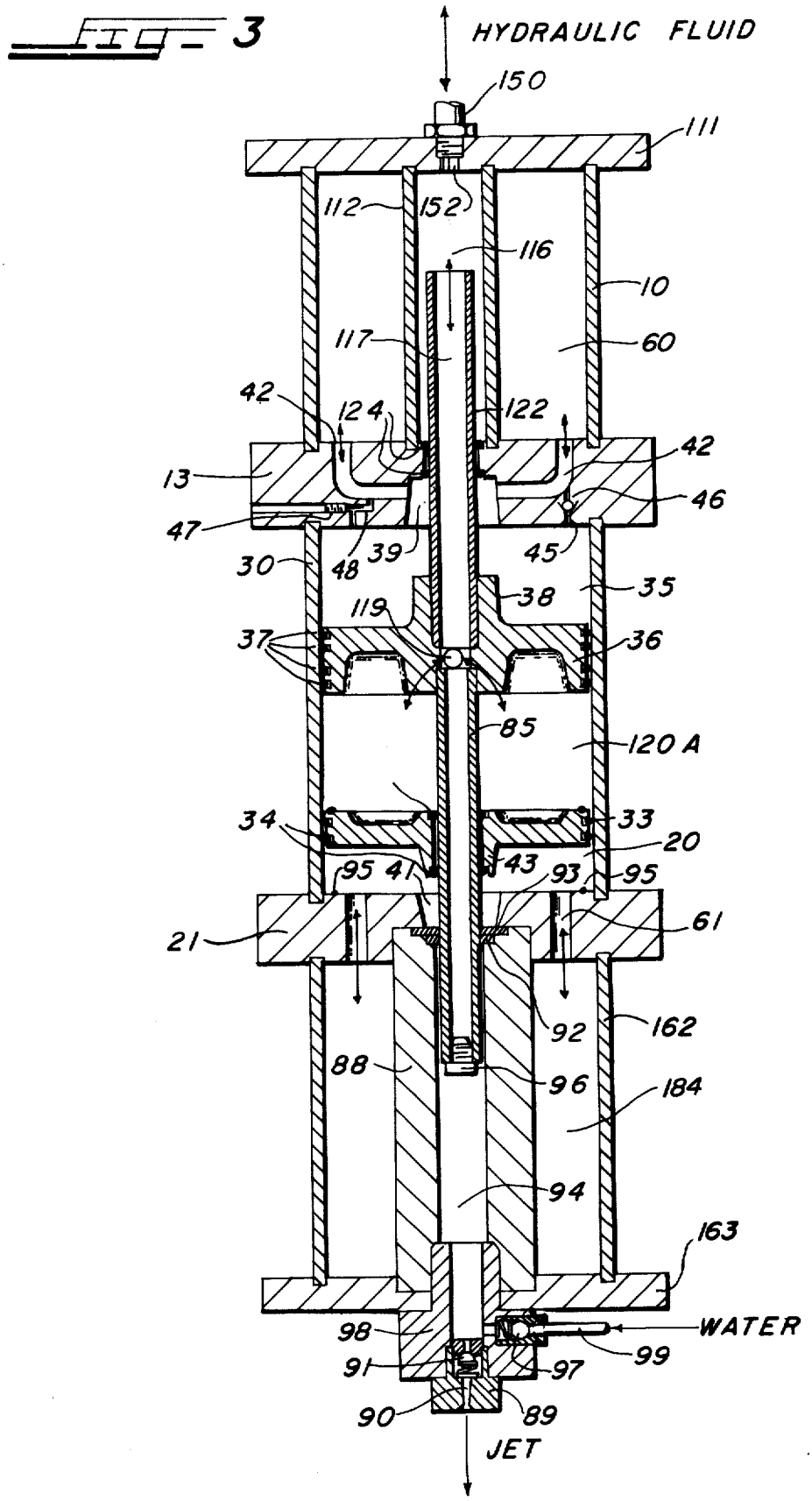
FIG. 3 is a partially sectioned view of a further embodiment of a pulsed water jet intensifier of this invention having gas driving, gas holding and oil cocking in a single working cylinder arrangement.

Another embodiment utilizing the principles of this invention is shown in FIG. 3 wherein the pulsed water jet intensifier comprises essentially the same components described with respect to FIG. 2 except a single wall working cylinder, alternate arrangement of action of fluid and gases, and a simplified water supply system. As shown in FIG. 3, hydraulic cocking fluid enters cocking fluid chamber 116 from cocking fluid conduit 150 through cocking fluid port 152 located in the central portion of upper driving cylinder external end plate 111. Cocking fluid chamber 116 is enclosed by cocking fluid cylinder wall 112 and is in communication with through cocking fluid passage 117 of cocking fluid communication cylinder 122, cocking fluid passages 119 and cocking chamber 120A. Cocking of power piston 36 is achieved by introducing high pressure cocking fluid into cocking chamber 120A. Power piston 36 is driven in its power stroke by driving gas stored in upper driving gas chamber 60 enclosed by driving gas cylinder wall 110 and working chamber 35 enclosed by working cylinder wall 30. Floating piston 33 is moved upwardly in the working cylinder by holding gas stored in lower holding gas chamber 184 enclosed by holding gas cylinder wall 162 and upper holding gas chamber 120. Water enters high pressure water chamber 94 through water supply check valve 97, located in high pressure water chamber end plug 98 closing the lower end of high pressure water chamber 94 and extending beyond holding gas chamber end plate 163.

At the end of the power stroke of the embodiment shown in FIG. 3, power piston 36 and floating piston 33 are at their lowest postions and are adjacent to each other, lower cushion chamber 41 being occupied by floating piston cushion plunger 43. To initiate the cocking stroke, high pressure cocking fluid is introduced into cocking chamber 120A through cocking fluid chamber 116, through cocking fluid passage 117 of cocking fluid communication cylinder 122 and cocking fluid passages 119, causing power piston 36 to rise pushing the working fluid which in this embodiment is driving gas in working chamber 35 back to upper driving gas chamber 60 through interchamber passages 42 located in the upper driving gas chamber internal end plate 113, thus increasing the driving gas pressure. At the same time, water enters high pressure water chamber 94 from water supply conduit 99 through water supply check valve 97. The water supply check valve 97 is spring loaded to a force level corresponding to the water supply pressure but lower than that of the high pressure water nozzle check valve 91 to prevent water from flowing out of the water jet nozzle 90 during the cocking operation. During this time, floating piston 33 is held down by the high pressure cocking fluid in cocking chamber 120A and remains in its lowest position. Upon power piston 36 reaching its uppermost position, power piston upper cushion plunger 38 enters power piston upper cushion chamber 39 and closes interchamber passages 42. Driving gas working fluid remaining in working chamber 35 is pushed back into the upper driving gas chamber 60 by power piston 36 through bleed passage 45 and bleed check valve 46. The pulsed water jet intensifier is then ready to be triggered to start the power stroke.

To trigger the power stroke, the high pressure cocking fluid in cocking chamber 120A is quickly exhausted by opening a dump valve located in the hydraulic fluid system external to the pulsed water jet intensifier, the cocking fluid thus flowing back to a fluid reservoir through cocking fluid passages 119, cocking fluid passage 117, fluid chamber 116 and cocking fluid port 152. The external hydraulic system (not shown) comprises storage means of sufficient size to accommodate the necessary volume of hydraulic cocking fluid and a liquid pump to provide desired pressure and rate of introduction of hydraulic fluid to the cocking fluid chamber and suitable valve means providing rapid exhaustion of the hydraulic cocking fluid from the cocking chamber. Simultaneously, floating piston 33 moves upwardly by pressure of the holding gas in lower holding gas chamber 184 to a position adjacent to power piston 36. The upward force exerted by floating piston 33 of power piston 36 enhances the complete drain of cocking fluid from cocking chamber 120A. Power piston 36 and floating piston 33 remain in their uppermost postions until a sufficient amount of driving gas has passed into working chamber 35 through interchamber passages 42 and bleed passage 48 controlled by bleed passage needle valve 37. Bleed passage valve 47 can be adjusted to control the timing of triggering the movement of power piston 36 as described with respect to FIG. 2. When power piston upper cushion plunger 38 leaves power piston upper cushion chamber 39, the downward movement of power piston 36 and floating piston 33 rapidly accelerates. The water in high pressure water chamber 94 is thus compressed by water ram 85 having solid end plug 96 and extruded out of the water jet nozzle 90. Solid end plug 96 is smaller in diameter than water ram 85 to enhance centering and to provide cushioning at the end of the stroke. The downward movement of power piston 36 and floating piston 33 is eventually stopped by the increased pressure of gas in lower cushion chamber 41 and by the water remaining in high pressure water chamber 94. Another cycle is initiated by introducing hydraulic cocking fluid to cocking chamber 120A by the liquid pump means.

The embodiment of this invention shown in FIG. 3 differs from that shown in FIGS. 1 and 2 primarily in the arrangement of cocking fluid in relation to the driving gas and holding gas. The term "holding gas" is used in describing the embodiment shown in FIG. 3 to indicate that the low pressure gas is used not in cocking the power piston 36 but rather in holding the two pistons in firing position and in allowing sufficient time for the cocking fluid to be drained out of the cocking chamber 120A. In the embodiment shown in FIG. 3, the holding gas reaches pressures of about 150 to 300 psi while the driving gas reaches pressures of about 2000 to 3000 psi. One advantage of the embodiment shown in FIG. 3 is the simplicity of water supply system which has some disadvantage in the pressure capability of the pulsed water jet intensifier due to the fatigue limitation of the design of high pressure end plug 98. Another advantage of the embodiment shown in FIG. 3 is the location of hydraulic fluid between the power piston and floating piston which allows all dynamic seals to be well lubricated, thus prolonging seal life. A further advantage of the embodiment shown in FIG. 3 is reduction of leakage of gas during the inactive period of the pulsed water jet intensifier by incorporating static seal 134 to further isolate driving gas and holding gas from the possible excape routes during maximum pressurization of each of the gases. A still further advantage of the embodiment shown in FIG. 3 is that any cocking fluid leaked across floating piston 33 is likely to settle in lower cushion cavity 41, thus enhancing the cushioning of lower cushion plunger 43 and easy clean-out. The simplicity of design of the embodiment shown in FIG. 3 allows the construction of a very compact pulsed water jet intensifier.

Figure 4:
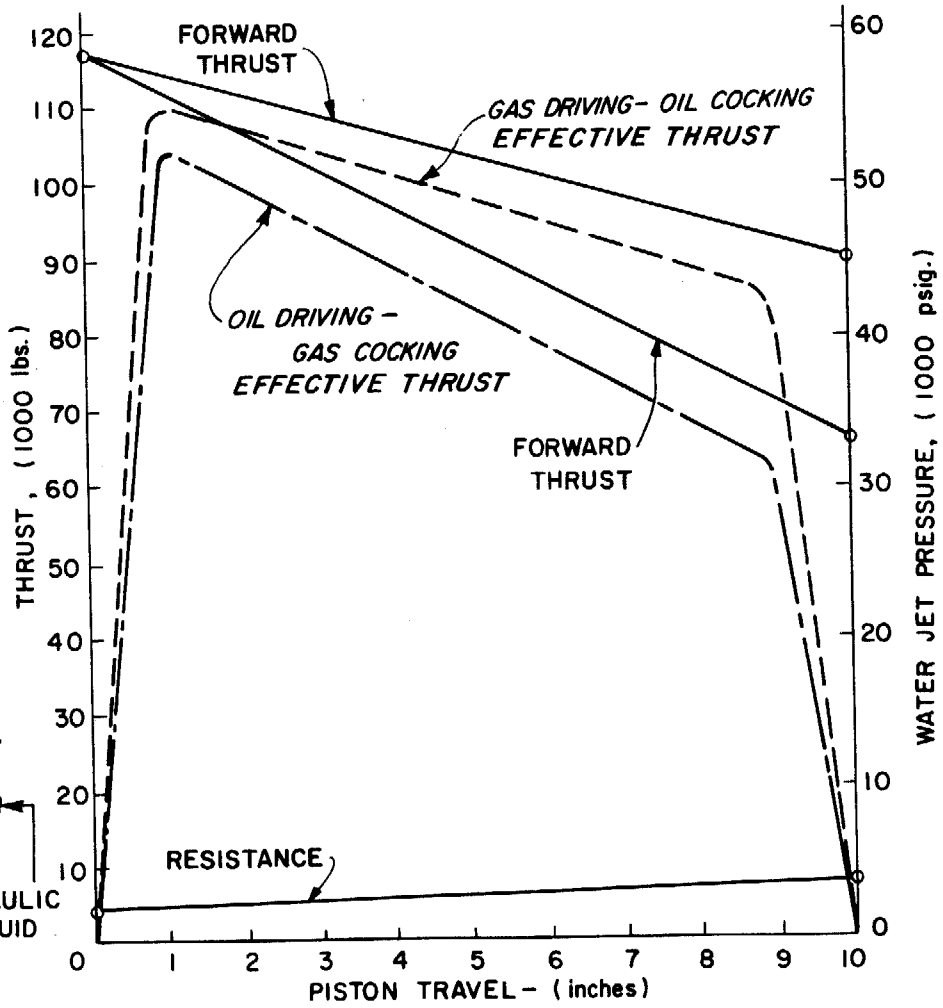
FIG. 4 is a graph showing the thrust-stroke length patterns which can be obtained by the apparatus and process of this invention.

The thrust stroke obtained by the thrust generator of this invention is a broad relatively flat thrust stroke as shown in FIG. 4. The thrust generator of this invention is particularly well suited for use in conjunction with the water jet intensifier as shown, providing a quiet and efficient pavement breaking and rock fracturing apparatus. The water jet apparatus of this invention incorporates design considerations providing the desired long pulse and relative flat thrust pattern to provide sufficient energy to the water jet for both drilling a deep hole in the concrete and creating high hoop stresses to initiate long fractures. The high cycling rate further enhances the efficiency.

The apparatus of this invention can be constructed from materials well known in the art as suitable to withstand the pressures encountered and various materials and methods of obtaining required seals are known to the art. The major components may be fabricated of mild steel, stainless steel, high-strength alloy steels and chrome steel. The seals may be constructed of rubber, plastic, bronze and other metals and composite materials as required by the pressures involved.

The control circuitries required have not been shown but are well known in the art to achieve the switching and valve control described. The high pressure working fluid valves may be controlled by electric, hydraulic, pneumatic or mechanical means energized by pressure sensing or position sensing means including pressure transducers, position sensors, contact switches and the like, for coaction with the power piston 36. Likewise, the pump means necessary to provide high pressure working fluid or cocking fluid and to pressurize the cocking gas within the apparatus are well known in the art.

The following examples are set forth only as specific exemplification of embodiments of this invention and should not be construed to limit the invention.

EXAMPLE I

A pulsed water jet intensifier was constructed as shown in FIG. 1 having the following dimensions and volumes. The power piston had a stroke length of 10 inches and a diameter of 8 inches and was connected to a water ram having a diameter of 1⅝ inches and the annular through cocking gas passage had a diameter of 2 inches, thus the power piston-water ram combination had a pressure intensification factor of 22.8. The total volume of the high pressure water chamber was 20 cubic inches and the stroke length of the high pressure water ram was 10 inches. The volume of the high pressure gas chambers was 1285 cubic inches and the volume of the working fluid charging chamber was 690 cubic inches, providing more oil than necessary to fill the entire working chamber which had a maximum volume of 471 cubic inches. The total volume of the high pressure gas of the intensifier varied in accordance with movement of the floating piston from a maximum of 2032 cubic inches to a minimum of 1342 cubic inches. The volume of the cocking gas chamber was 1413 cubic inches and the total volume of cocking gas varied from a maximum of about 2000 cubic inches to a minimum of about 1450 cubic inches depending upon the position of the power piston. When the pulsed water jet intensifier was operated with hydraulic oil provided at 2650 psig and the driving chambers were precharged with nitrogen to a pressure of 1400 psig, the maximum driving pressure of the nitrogen at the time of triggering was 2500 psig. The overall pressure drop of driving nitrogen during the complete power stroke, was about 1100 psig. The cocking chamber was precharged with nitrogen to a pressure of about 100 psig and this pressure was increased to about 160 psig at the end of the power stroke as the total volume of cocking nitrogen was decreased. Under these operating conditions, the apparatus developed a peak water jet pressure of 54000 psig with a 0.08 inch diameter nozzle. The water jet pressure profile produced by the apparatus is shown in FIG. 3. The duration of the jet pulse was about 0.1 second.

The repetitive rate of the intensifier is essentially governed by the capacity of the pump used to supply the high pressure oil working fluid. Operating a piston pump at a capacity of 32 gpm at 2650 psig, a repetitive rate of 6 cycles per minute was achieved.

EXAMPLE II

A pulsed water jet intensifier was constructed as shown in FIG. 2 having the essential dimensions the same as described in Example I. Operating the intensifier as shown in FIG. 2 under conditions identical to those described in Example I, a peak water jet pressure of about 56000 psig was obtained, as shown in FIG. 3, due primarily to the larger volume of driving nitrogen contained in the intensifier. By adjusting the bleed passage needle valve, the descent of the power piston was initiated just before the floating piston reached the lowest position. By so doing, the impact between the power piston and the floating piston was minimized and the time required to operate the intensifier reduced. With the engine-pump operating at 32 gpm and 2650 psig hydraulic pressure, the intensifier was operated at a repetitive rate of 8 cycles per minute.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

I claim:

1. A thrust generator comprising:

a single substantially gas-tight combination working-cocking cylinder, a power piston adapted for substantially gas-tight reciprocating motion within said cylinder and dividing said cylinder into a substantially gas-tight working cylinder containing working fluid on one side of the power piston and a substantially gas-tight cocking cylinder containing cocking fluid on the other side of said power piston;

a closed driving gas chamber in pressure transmission communication with said working cylinder and containing driving gas providing driving force to said power piston for the power stroke, said driving gas being pressurized in said driving gas chamber by movement of said power piston reducing the volume of said working cylinder;

a cocking fluid chamber in fluid transfer communication with said cocking cylinder and containing cocking fluid providing force to said power piston for the cocking stroke of said power piston;

means for cyclic supplying pressurized hydraulic fluid to and draining hydraulic fluid through a hydraulic fluid outlet valve from said working-cocking cylinder;

a cocking fluid communication cylinder extending from the working chamber side of said power piston through the central portion of said working chamber into said cocking fluid chamber providing passage of said cocking fluid and centered movement of said power piston in said working-cocking cylinder;

a floating piston separating said hydraulic fluid from gas;

trigger valve means providing initial flow of working fluid into said working cylinder to initiate the power stroke of power piston; and control means for control of said hydraulic fluid outlet valve and trigger valve.

2. The thrust generator of claim 1 having oil driving and gas cocking wherein said working fluid is hydraulic fluid supplied to said working cylinder and said floating piston is an annular piston reciprocating in a chamber annular to said working cylinder and in opposing cycle to said power piston, one end of said annular chamber in communication through interchamber passages with said working chamber and the other end in communication with said driving gas chamber.

3. The thrust generator of claim 2 wherein said interchamber passages are closed at the end of the power stroke by said floating piston and at the end of the cocking stroke by said power piston.

4. The thrust generator of claim 3 wherein a working fluid bleed passage having said trigger valve means therein is provided from said hydraulic fluid supply means directly into the end of said working cylinder.

5. The thrust generator of claim 4 wherein said power piston has a cushion plunger on each side, each end of said working-cocking cylinder has a cushion plunger chamber adapted for receiving the respective cushion plunger, said power piston has thrust transmission means extending in substantially air tight relation through an end of said working-cocking chamber and control means for cyclic operation of said outlet valve and trigger valve.

6. The thrust generator of claim 1 having gas driving and oil cocking wherein said working fluid is driving gas and said floating piston is within the cocking cylinder with said cocking fluid being gas between said power piston and said floating piston and said hydraulic fluid is supplied to said cocking cylinder, said floating piston separating the cocking gas and hydraulic fluid.

7. The thrust generator of claim 6 wherein a working fluid bleed passage having said trigger valve means therein is provided between said driving gas chamber and the end of said working cylinder.

8. The thrust generator of claim 7 wherein said power piston has thrust transmission means extending in substantially air tight relation through an end of said working-cocking chamber and control means for cyclic operation of said outlet valve and trigger valve.

9. The thrust generator of claim 1 having gas driving and oil cocking wherein said working fluid is driving gas and said floating piston is within the cocking cylinder with said cocking fluid being hydraulic fluid between said power piston and said floating piston, said floating piston separating the cocking liquid and holding gas at said other end of said cocking chamber and a holding gas chamber in communication with said other end of said cocking chamber.

10. The thrust generator of claim 7 wherein a working gas bleed passage is provided between said driving gas chamber and the end of said working cylinder.

11. The thrust generator of claim 10 wherein said power piston has thrust transmission means extending in substantially air tight relation through an end of said working-cocking chamber and control means for operation of said outlet valve and trigger valve.

12. A high pressure pulsed water jet intensifier comprising:

a single substantially gas-tight combination working-cocking cylinder, a power piston adapted for substantially gas-tight reciprocating motion within said cylinder and dividing said cylinder into a substantially gas-tight working cylinder containing working fluid on one side of the power piston and a substantially gas-tight cocking cylinder containing cocking fluid on the other side of said power piston;

a closed driving fluid chamber in pressure transmission communication with said working cylinder and containing driving gas providing driving force to said power piston for the power stroke, said driving gas being pressurized in said driving gas chamber by movement of said power piston reducing the volume of said working cylinder;

a cocking fluid chamber in fluid transfer communication with said cocking cylinder and containing cocking fluid providing force to said power piston for the cocking stroke of said piston;

means for cyclic supplying pressurized hydraulic fluid to and draining hydraulic fluid through a hydraulic fluid outlet valve from said working-cocking cylinder;

a cocking fluid communication cylinder extending from the working chamber side of said power piston through the central portion of said working chamber into said cocking fluid chamber providing passage of said cocking fluid and centered movement of said power piston in said working-cocking cylinder;

a floating piston separating said hydraulic fluid from gas;

trigger valve means providing initial flow of working fluid into said working cylinder to initiate the power stroke of power piston;

control means for control of said hydraulic fluid outlet valve and trigger valve; and a water ram extending from the other side of said power piston in substantially gas-tight relation into a high pressure water chamber, said water ram having sealing means for substantially gas-tight reciprocation within said high pressure water chamber, said high pressure water chamber having water introduction means and having nozzle means at one end for emission of a high pressure pulsed water jet.

13. The high pressure pulsed water jet intensifier of claim 12 wherein said nozzle means has an orifice of about 0.04 to about 0.12 inch diameter.

14. The high pressure pulsed water jet intensifier of claim 12 wherein said water introduction means comprises:

said cocking fluid communication cylinder having a flanged end in substantially gas-tight reciprocating relation within a water cylinder and a water inlet tube in its central portion extending through said cocking fluid communication cylinder, said water inlet tube having a water inlet at one end in communication with said water cylinder and a water outlet at the other end in communication with one end of said water ram; and said water ram having a water passage through its central portion said water passage in communication with said outlet of said water inlet tube and at the other end in communication with said high pressure water chamber.

15. The high pressure pulsed water jet intensifier of claim 14 additionally having an annular cocking fluid passage between said cocking fluid communication cylinder and said water inlet tube in communication with said cocking fluid chamber at one end and with said cocking cylinder through a cocking fluid passage through said power piston at the other end.

16. The high pressure pulsed water jet intensifier of claim 12 having oil driving and gas cocking wherein said working fluid is hydraulic fluid supplied to said working cylinder and said floating piston is an annular piston reciprocating in a chamber annular to said working cylinder and in opposing cycle to said power piston, one end of said annular chamber in communication through interchamber passages with said working chamber and the other end in communication with said driving gas chamber.

17. The high pressure pulsed water jet intensifier of claim 16 wherein said interchamber passages are closed at the end of the power stroke by said floating piston and at the end of the cocking stroke by said power piston.

18. The high pressure pulsed water jet intensifier of claim 16 wherein a working fluid bleed passage having said trigger valve means therein is provided from said hydraulic fluid supply means directly into the end of said working cylinder.

19. The high pressure pulsed water jet intensifier of claim 18 wherein said power piston has a cushion plunger on each side, each end of said working-cocking cylinder has a cushion plunger chamber adapted for receiving the respective cushion plunger, said power piston has thrust transmission means extending in substantially air tight relation through one end of said working-cocking chamber and control means for cyclic operation of said outlet valve and trigger valve.

20. The high pressure pulsed water jet intensifier of claim 12 wherein said working fluid is driving gas and said floating piston is within the cocking cylinder with said cocking fluid being between said power piston and said floating piston and said hydraulic fluid is supplied to said cocking cylinder, said floating piston separating the cocking gas and hydraulic fluid.

21. The high pressure pulsed water jet intensifier of claim 20 wherein a working fluid bleed passage having said trigger valve means therein is provided between said driving gas chamber and the end of said working cylinder.

22. The high pressure pulsed water jet intensifier of claim 21 wherein said power piston has thrust transmission means extending in substantially air tight relation through one end of said working-cocking chamber and control means for cyclic operation of said outlet valve and trigger valve.

23. The high pressure pulsed water jet intensifier of claim 12 wherein said working fluid is driving gas and said floating piston is within the cocking cylinder with said cocking fluid being hydraulic fluid between said power piston and said floating piston, said hydraulic fluid being supplied to said cocking cylinder from said cocking fluid chamber through said cocking fluid communication cylinder and a passage through said power piston, said floating piston separating the cocking liquid and holding gas at said other end of said cocking chamber and a holding gas chamber in communication with said other end of said cocking chamber.

24. The high pressure pulsed water jet intensifier of claim 23 wherein a working gas bleed passage is provided between said driving gas chamber and the end of said working cylinder.

25. The high pressure pulsed water jet intensifier of claim 24 wherein said power piston has thrust transmission means extending in substantially air tight relation through an end of said working-cocking chamber and control means for operation of said outlet valve and trigger valve.

26. The high pressure pulsed water jet intensifier of claim 25 wherein said water introduction means comprises a water supply check valve in a water supply conduit into said high pressure water chamber.

* * * * *